US006331131B1

(12) United States Patent
Selevan

(10) Patent No.: US 6,331,131 B1
(45) Date of Patent: Dec. 18, 2001

(54) SELF INFLATING NOISE MAKER

(75) Inventor: Russell Morris Selevan, Jacksonville, FL (US)

(73) Assignee: Ja-Ru, Inc., Jacksonville, FL (US)

( * ) Notice: Subject to any disclaimer, the term of this patent is extended or adjusted under 35 U.S.C. 154(b) by 0 days.

(21) Appl. No.: 09/568,184

(22) Filed: May 9, 2000

Related U.S. Application Data

(60) Provisional application No. 60/184,610, filed on Feb. 24, 2000.

(51) Int. Cl.[7] ..... A63H 3/06

(52) U.S. Cl. ..... 446/220; 446/222; 446/188

(58) Field of Search ..... 446/176, 180, 446/183, 184, 185, 186, 187, 188, 213, 220, 224, 397; 604/133

(56) References Cited

U.S. PATENT DOCUMENTS 1,547,354 * 7/1925 Baum ..... 446/185
3,871,377 * 3/1975 Treace ..... 604/133
3,977,292 * 8/1976 Favilli et al. ..... 446/184
4,212,132 * 7/1980 Lewanoni ..... 446/185
4,917,645 * 4/1990 Amici et al. ..... 446/188
4,936,809 * 6/1990 Auer et al. ..... 446/184
5,462,473 * 10/1995 Sheller ..... 446/183

* cited by examiner

*Primary Examiner*—Sam Rimell
(74) *Attorney, Agent, or Firm*—Darby & Darby

(57) ABSTRACT

A noise-maker includes an enclosed membrane having an inlet and an outlet that is filled with porous material. The noise-maker is in an inflated state when the porous material is saturated with air and a compressed state when the air is forced out of the porous material. When pressure is applied to the noise-maker, the air inside the membrane is forced through the outlet and the noise-maker reaches the compressed state. When the pressure is released, the noise-maker changes from the compressed state to the inflated state as air flows through the inlet.

9 Claims, 2 Drawing Sheets

FRONT VIEW
AREA OF CROSS SECTION
(SEE ACCOMPANYING ILLUSTRATION)

100
118
GROMMET STYLE
AIR INLET ON
SURFACE OF TOY
122
FLEXIBLE LATEX
(OR SIMILAR) MEMBRANE
110
114
116
AIR OUTLET 112

AIR INLET 118
SIDE VIEW
AIR OUTLET
112
114
116
110

CROSS SECTION - NORMAL INFLATED STATE

CROSS SECTION - COMPRESSED STATE

SELF INFLATING NOISE MAKER

The enclosed application is based upon one Provisional Patent Application Ser. No. 60/184,610 filed Feb. 24, 2000. Applicants claim the benefit of the filing, dates of the aforesaid provisional application under 35 U.S.C. §119(E)(1).

FIELD OF THE INVENTION

The present invention related to inflatable devices.

BACKGROUND OF THE INVENTION

Many noisemakers work by rapidly forcing air through a mechanism to produce a sound. Inflatable noise-makers have a container which is filled with air and then the air is forced out of the container through a single outlet producing a sound. Once the noise-maker is used to produce a sound, it must be refilled with air in order to produce sound again.

Therefore, there is a need in the art for a noise-maker that refills with air after each use without directed effort from the user. The present invention satisfies this and other needs.

SUMMARY OF THE INVENTION

The present invention is a self-inflating, noise-maker. In accordance with a currently preferred exemplary embodiment, a noisemaker includes an enclosed membrane having an inlet and an outlet that is filled with porous material. The noise-maker is in an inflated state when the porous material is saturated with air and a compressed state when the air is forced out of the porous material. When pressure is applied to the noise-maker, the air inside the membrane is forced through the outlet and the noisemaker reaches the compressed state. When the pressure is released, the noise-maker changes from the compressed state to the inflated state as air flows through the inlet.

DETAILED DESCRIPTION OF THE INVENTION

Referring now to FIGS. 1–4, a noisemaker 100 is illustrated. In the preferred embodiment of the present invention, a self-inflating noise-maker is made of an elastic material to form a container having an air inlet and an air outlet and is filled with a foam material. Noise is produced by forcing a flow of air out of the container at a rapid rate. The container automatically returns to an inflated state due to the shape-recovery properties of the foam material within the container.

Figure 1:
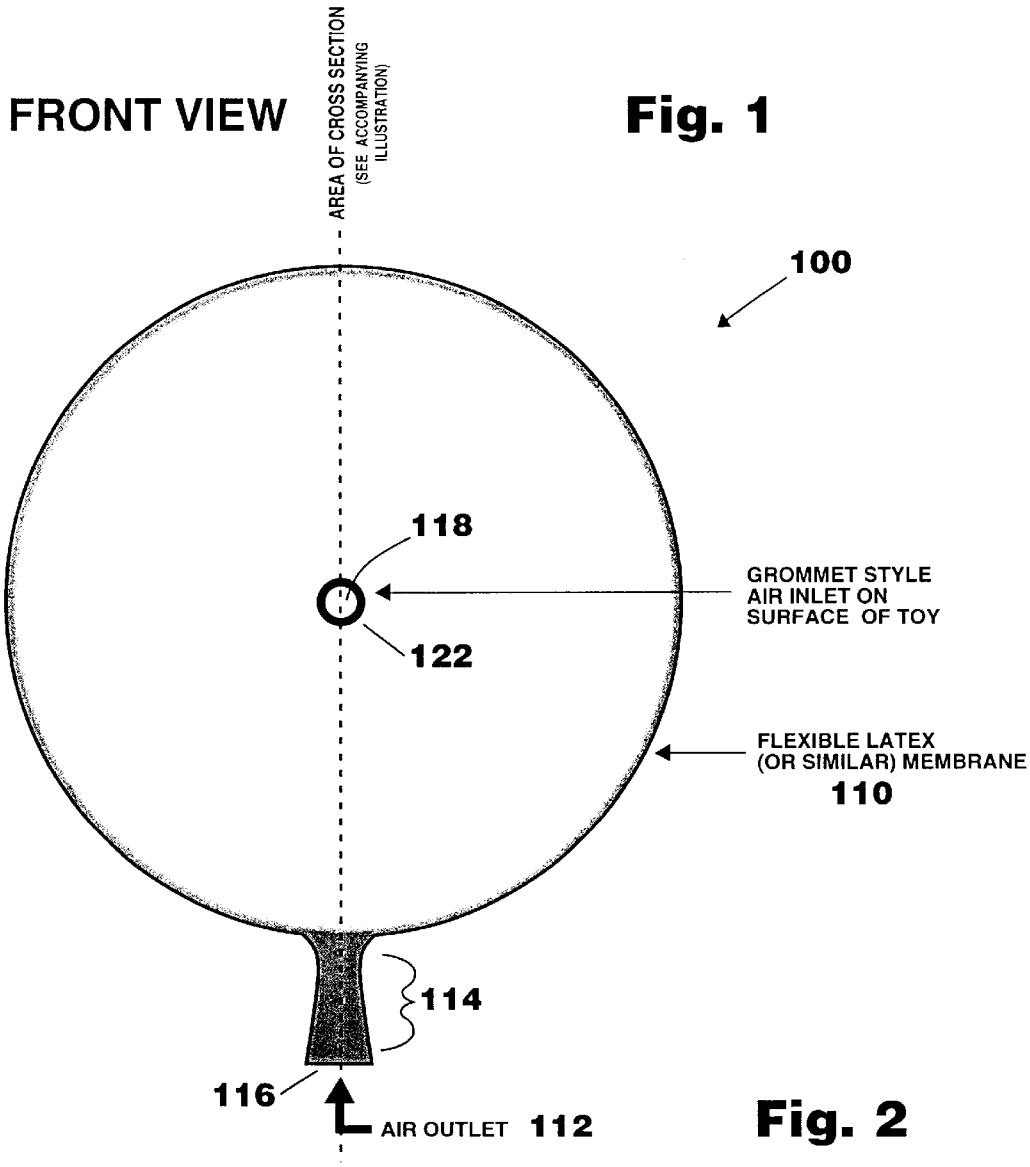
FIG. 1 is a schematic front view of the preferred embodiment of the present invention.
Figure 2:
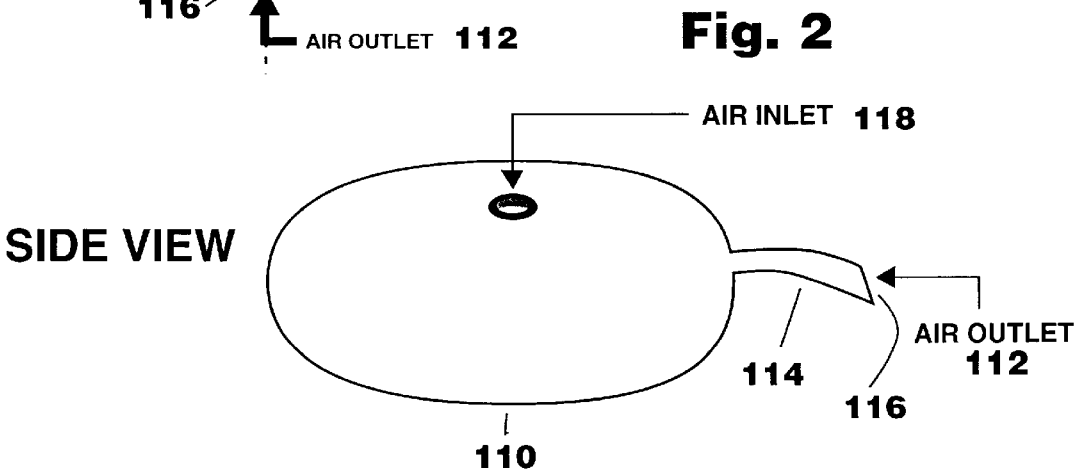
FIG. 2 is a schematic side view of the preferred embodiment.

Referring to FIGS. 1 and 2, container 100 is made of flexible latex or similar non-porous membrane 110, typically forming a flattened spherical shape. The membrane is made of an elastic material so that it will expand as air is accumulated inside the container. Likewise, the elastic material will contract as air escapes from the container. Container 100 has an air inlet 118 and an air outlet 112. The air outlet

Figure 3:
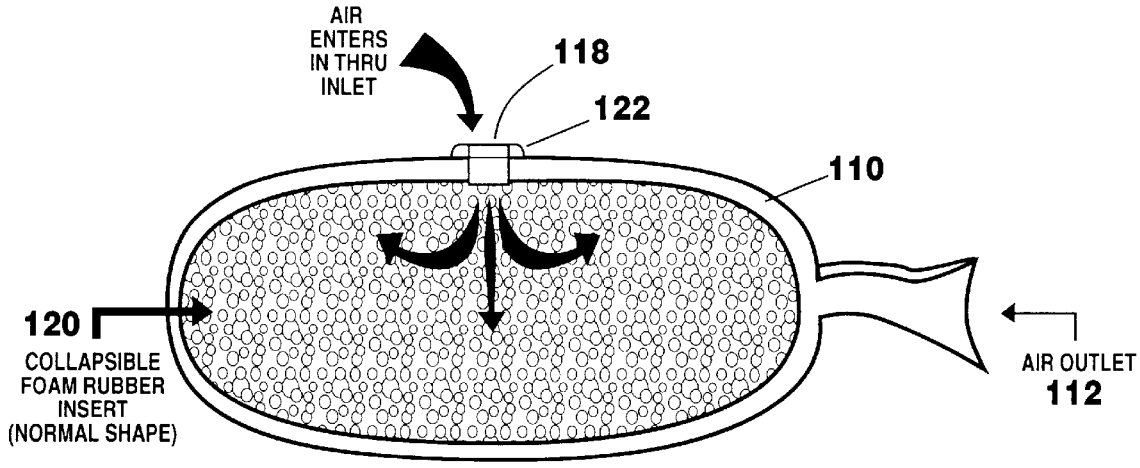
FIG. 3 is a schematic cross-sectional view of the preferred embodiment in the inflated state.
Figure 4:
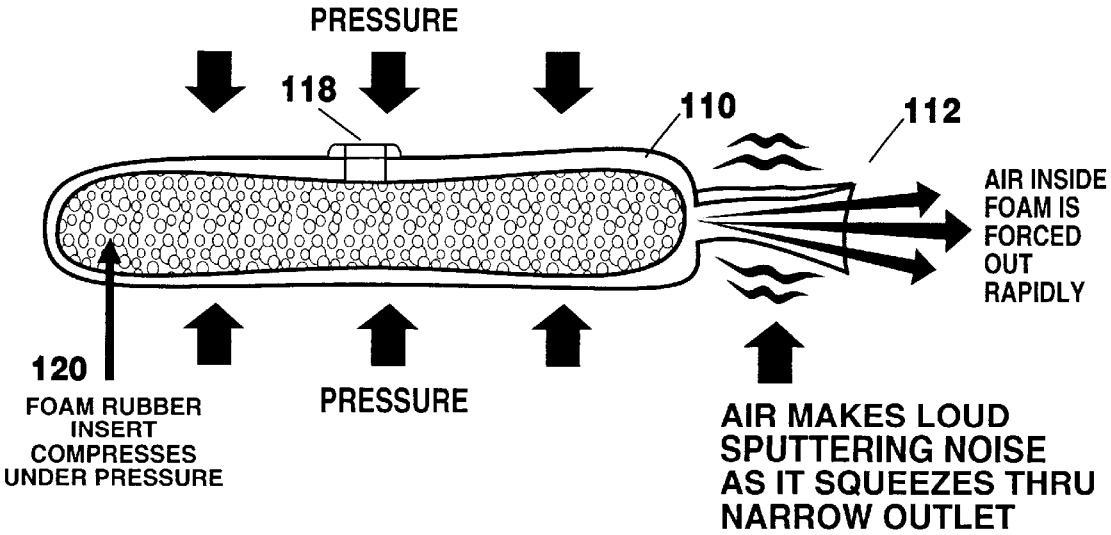
FIG. 4 is a schematic cross-sectional view of the preferred embodiment in the compressed state.

112 is an extension of the membrane 110 of the container protruding from the spherical shape, namely, a tab 114. The air inlet 118 of the container may be a hole in the membrane material. Optionally, the hole may be secured with a grommet 122. Typically, the hole is centered on one side of the container 100. Referring to FIGS. 3 and 4, the container is filled with a compressible porous material 120, such as foam rubber or sponge, that has a natural expanded state retaining air and a compressed state when pressure is applied forcing the air out of the foam material.

Typically, the container 100 is constructed by preparing two cutouts of the membrane material 110 in the shape of a disk with a tab 114 and then sealing the two pieces of membrane around all the edges except for an edge 116 disposed at the end of the tab. Hence, the perimeter of the membrane container including the sides of the tabs are sealed and the only porthole is at the end of the tab 116, thereby forming the air outlet 112. The foam material 120 is placed inside the membrane container, preferably before the two cutouts are sealed together. The amount of foam material is sufficient to give the membrane some height. The tab 114 portion has no foam material and therefore remains flat and taught (contracted). To construct the air inlet 118, one cutout membrane may be punctured, preferably with a hole punch, before the two cutouts are sealed together. Optionally, a grommet 122 may be attached to the hole to secure it, including preventing enlargement of the hole. Alternatively, a one-way valve may be used as the air inlet. However, experiment has demonstrated that sufficient air is retained in the foam material without the use of a valve.

Referring to FIG. 3, when no pressure is applied the noise-maker remains in its inflated state in which the foam material is saturated with air. Referring to FIG. 4, when pressure is applied simultaneously from both sides, the top and bottom (arbitrary designations), the noise maker changes to its compressed state. The applied pressure causes the foam to compress which causes the air within the foam (within the container) to be forced out rapidly through the air outlet. The air flow through the narrow opening and flat tab constituting the air outlet produces a sputtering noise. Upon release of the applied pressure, the noise-maker will return to the position of FIG. 3 due to the foam material 120 returning to its natural expanded state. During this movement, air enters container 100 through inlet 118.

Having described the presently preferred exemplary embodiment for a noise maker in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A noise maker comprising:

a membrane being enclosed to define a collapsible container, said membrane having an inlet and an outlet, said outlet being formed by flat flexible pieces joined together defining a passage therein, said collapsible container being filled with a compressible porous material, wherein said outlet produces a sound when said container is compressed.

2. The noise maker, as in claim 1, said collapsible container moving between an inflated position and a compressed position, wherein said container moves from the inflated position to the compressed position in response to pressure being applied to said membrane forcing, air from within said container through said outlet.

3. The noise maker, as in claim 2, where said container moves from the compressed position to the inflated position in response to the release of pressure thereby forcing air into said container through said inlet.

4. The noise maker, as in claim 1, wherein said inlet is an opening in the membrane.

5. The noise maker, as in claim 4, wherein said opening is reinforced with a grommet.

6. The noise maker, as in claim 1, wherein said inlet is a one-way valve.

7. The noise maker, as in claim 1, wherein said compressible porous material is a sponge.

8. The noise maker, as in claim 2, wherein said compressible porous material substantially completely fills said container in both said inflated position and in said compressed position.

9. The noise maker of claim 1, wherein said flat flexible pieces derive from a single folded piece.

* * * * *